US007267564B2

(12) United States Patent
Bauman et al.

(10) Patent No.: US 7,267,564 B2
(45) Date of Patent: Sep. 11, 2007

(54) LEVER TYPE ELECTRICAL CONNECTOR

(75) Inventors: Ronald Bauman, Oxford, MI (US); Kurt P. Dekoski, Macomb, MI (US)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 11/292,197

(22) Filed: Dec. 1, 2005

(65) Prior Publication Data

US 2007/0128900 A1 Jun. 7, 2007

(51) Int. Cl.
*H01R 13/62* (2006.01)

(52) U.S. Cl. ..... 439/157

(58) Field of Classification Search ..... 439/157, 439/372, 160, 152, 341, 266
See application file for complete search history.

(56) References Cited

U.S. PATENT DOCUMENTS

| | | | |
|---|---|---|---|
| 5,181,857 | A | 1/1993 | Layser |
| 5,463,912 | A | 11/1995 | Inoue et al. |
| 5,876,225 | A | 3/1999 | Katsuma et al. |
| 5,888,081 | A | 3/1999 | Konoya et al. |
| 5,919,055 | A | 7/1999 | Hattori |
| 5,938,458 | A | 8/1999 | Krehbiel et al. |
| 5,975,928 | A | 11/1999 | Tsuji |
| 6,019,618 | A | 2/2000 | Nakata |
| 6,030,235 | A | 2/2000 | Ittah et al. |
| 6,030,237 | A | 2/2000 | Roth |
| 6,039,586 | A | 3/2000 | Kitamura |
| 6,174,191 | B1 | 1/2001 | Maue et al. |
| 6,193,531 | B1 | 2/2001 | Ito et al. |
| 6,203,340 | B1 | 3/2001 | Yamashita et al. |
| 6,213,795 | B1 | 4/2001 | Drescher et al. |
| 6,217,354 | B1 | 4/2001 | Fencl et al. |
| 6,264,485 | B1 | 7/2001 | Saka et al. |
| 6,305,957 | B1 | 10/2001 | Fink et al. |
| 6,319,050 | B1 | 11/2001 | Miyazaki et al. |
| 6,325,647 | B1 | 12/2001 | May et al. |
| 6,341,968 | B1 | 1/2002 | Grant |
| 6,354,852 | B2 | 3/2002 | Noro et al. |

(Continued)

FOREIGN PATENT DOCUMENTS

DE 10 2004 063 236 A1 8/2005

(Continued)

*Primary Examiner*—Tho D. Ta
*Assistant Examiner*—Vanessa Girardi
(74) *Attorney, Agent, or Firm*—Charles S. Cohen

(57) ABSTRACT

A lever type electrical connector assembly includes a connector housing provided for mounting a plurality of terminals. The housing includes a forward end for mating with a complementary mating connector and a rear end for receiving a plurality of electrical wires for termination to the terminals. A mating assist lever is pivotally movably mounted on the housing for movement in a pivotal operating stroke between a pre-load position at one end of the stroke to allow the electrical wires to be terminated to the terminals and a mated position at an opposite end of the stroke. Interengaging latches are provided between the connector housing and the mating assist lever to hold the lever in its pre-load position. A wire dress cover is mountable over the rear end of the housing to protect the connections between the electrical wires and the terminals. The wire dress cover has release means for disengaging the latches to allow the mating assist lever to be pivoted after the cover is mounted on the housing.

26 Claims, 6 Drawing Sheets

U.S. PATENT DOCUMENTS

| | | | | |
|---|---|---|---|---|
| 6,361,356 | B1 | 3/2002 | Heberlein et al. | |
| 6,413,105 | B2 | 7/2002 | Noro et al. | |
| 6,447,312 | B1 | 9/2002 | Takata | |
| 6,461,177 | B1 | 10/2002 | Saka et al. | |
| 6,488,516 | B2 | 12/2002 | Osawa et al. | |
| 6,540,532 | B1 * | 4/2003 | Martin et al. | 439/157 |
| 6,551,118 | B2 | 4/2003 | Langolf et al. | |
| 6,558,176 | B1 | 5/2003 | Martin et al. | |
| 6,602,082 | B2 | 8/2003 | Nishide et al. | |
| 6,666,698 | B2 | 12/2003 | Beck, Jr. et al. | |
| 6,705,881 | B2 | 3/2004 | Tsuchiya | |
| 6,705,882 | B2 | 3/2004 | Casses | |
| 6,733,313 | B2 | 5/2004 | Shinozaki et al. | |
| 6,736,655 | B2 | 5/2004 | Martin et al. | |
| 6,755,674 | B2 | 6/2004 | Fujii et al. | |
| 6,767,231 | B1 | 7/2004 | Martin et al. | |
| 6,832,922 | B2 | 12/2004 | Kozono et al. | |
| 6,854,992 | B2 | 2/2005 | Martin et al. | |
| 6,905,355 | B2 | 6/2005 | Fukamachi | |
| 7,025,610 | B2 * | 4/2006 | Demuth | 439/157 |
| 2002/0173186 | A1 | 11/2002 | Tsuchiya | |
| 2004/0192090 | A1 * | 9/2004 | Flowers et al. | 439/157 |
| 2006/0040535 | A1 * | 2/2006 | Koshy et al. | 439/157 |
| 2006/0040536 | A1 * | 2/2006 | Putnam et al. | 439/157 |
| 2006/0089031 | A1 * | 4/2006 | Flowers et al. | 439/157 |

FOREIGN PATENT DOCUMENTS

| | | | |
|---|---|---|---|
| EP | 0 954 062 | A2 | 11/1999 |
| EP | 1 077 512 | A2 | 2/2001 |
| EP | 1 306 931 | A1 | 5/2003 |
| EP | 1 418 649 | A1 | 5/2004 |

* cited by examiner

LEVER TYPE ELECTRICAL CONNECTOR

FIELD OF THE INVENTION

This invention generally relates to the art of electrical connectors and, particularly, to an electrical connector having a lever whereby mating and unmating of the connector with a second connector is effected by rotation of the lever.

BACKGROUND OF THE INVENTION

A typical lever type electrical connector assembly includes a first connector which has an actuating or mating assist lever rotatably mounted thereon for connecting and disconnecting the connector with a complementary mating second connector. The actuating lever and the second connector typically have a cam groove/cam follower arrangement for drawing the second connector into mating condition with the first connector in response to rotation of the lever.

A common structure for a lever type electrical connector of the character described above is to provide a generally U-shaped lever structure having a pair of lever arms which are disposed on opposite sides of the first ("actuator") connector. The lever arms may have cam grooves for engaging cam follower projections or posts on opposite sides of the second ("mating") connector. The connectors often are used where large forces are required to mate and unmate a pair of connectors. For instance, terminal and housing frictional forces encountered during connecting and disconnecting the connectors may make the process difficult to perform by hand.

Such lever type connectors typically include a connector housing mounting a plurality of terminals. The housing includes a forward end for mating with the second connector and a rear end for receiving a plurality of electrical wires for termination to the terminals. The lever is pivotally mounted on the housing for movement between a pre-load position allowing the electrical wires to be easily terminated to the terminals and a mated position for drawing the mating connector into mating condition with the actuator connector. After the wires are terminated to the terminals and before the lever is pivoted to its mated position, a wire dress cover is positioned over the rear end of the housing.

Problems still are encountered with such lever type connectors. One problem revolves around the fact that the lever structure is unrestrained and has a tendency to move around or "flop" before the electrical wires are terminated and the connector is fully assembled. In particular, the actuator connector housing, with the terminals mounted therein and the lever pivotally mounted thereon, may be shipped to a customer and, thereafter, the customer terminates the electrical wires to the terminals and installs the wire dress cover before mating with the mating connector. The lever has a tendency to move all around during shipping and handling. Another problem involves the space that the lever structure occupies at one side of the connector housing when the lever is in its pre-load position. If two connectors are mounted back-to-back, the pre-load positions of the levers of the connectors prevent the connectors from being mounted sufficiently close to each other. The present invention is directed to solving these problems.

SUMMARY OF THE INVENTION

An object, therefore, of the invention is to provide a new and improved lever type electrical connector assembly of the character described.

In the exemplary embodiment of the invention, a connector housing is provided for mounting a plurality of terminals. The housing includes a forward end for mating with a complementary mating connector and a rear end for receiving a plurality of electrical wires for termination to the terminals. A mating assist lever is pivotally movably mounted on the housing for movement in a pivotal operating stroke between a pre-load position at one end of the stroke to allow the electrical wires to be terminated to the terminals and a mated position at an opposite end of the stroke. Interengaging latch means are provided between the connector housing and the mating assist lever to hold the lever in its pre-load position. A wire dress cover is mountable over the rear end of the housing to protect the connections between the electrical wires and the terminals. The wire dress cover has release means for disengaging the latch means to allow the mating assist lever to be pivoted after the cover is mounted on the housing.

According to one aspect of the invention, the interengaging latch means are located for disengagement by the release means on the wire dress cover automatically in response to mounting the cover onto the connector housing. The interengaging latch means comprise at least one flexible latch member, and the release means engages and flexibly disengages the latch member. As disclosed herein, a pair of the latch members are provided at opposite sides of the lever.

According to another aspect of the invention, the mating assist lever is generally U-shaped and includes a pair of mating actuating arms pivotally mounted on opposite sides of the connector housing. The interengaging latch means are disposed between both actuating arms and the opposite sides of the housing. The release means are disposed on opposite side walls of the wire dress cover. As disclosed herein, the release means comprise a release boss projecting outwardly from each side wall of the wire dress cover.

According to a further aspect of the invention, second interengaging latch means are provided between the connector housing and the mating assist lever to hold the lever in a pre-mated position between the pre-load and mated positions. The second interengaging latch means are located for release by the complementary mating connector. As disclosed herein, the second interengaging latch means comprise a flexible latch arm engageable with a latch release shoulder on the mating connector.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 9A:
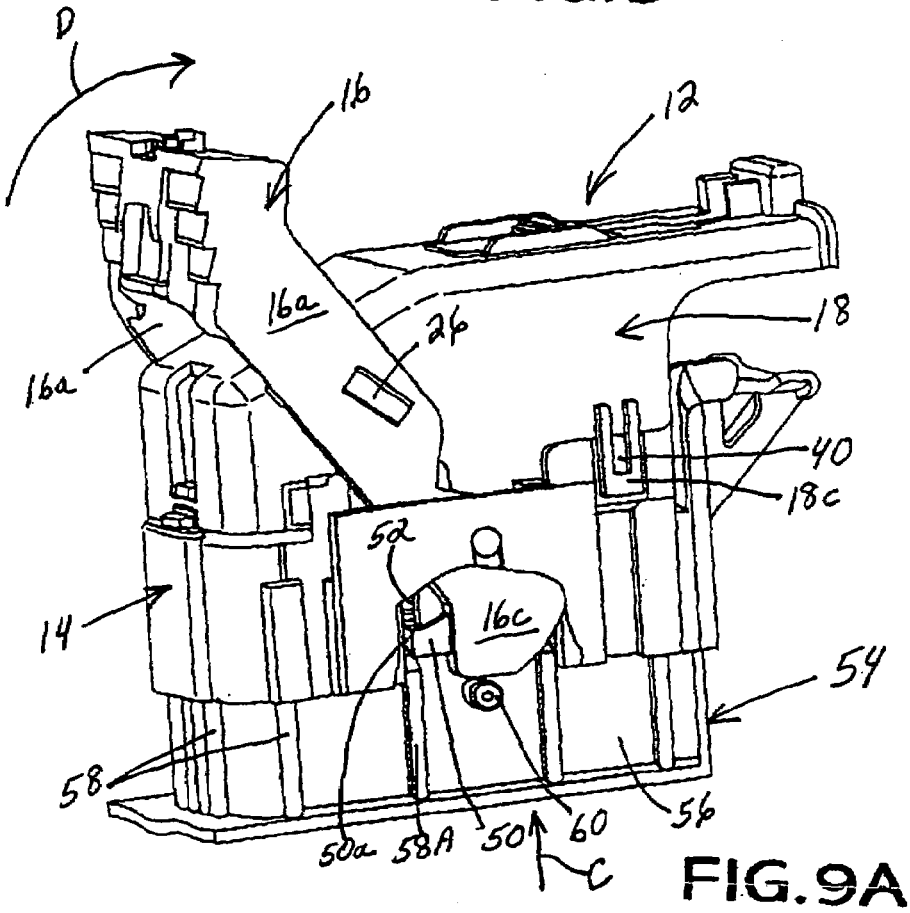
FIG. 9A is a perspective view of the connector assembly being partially mated with a complementary mating connector, with the lever structure in its pre-mated position and with the housing partially cut-away to show the second latch means which holds the lever structure in its pre-mated position.
Figure 9B:
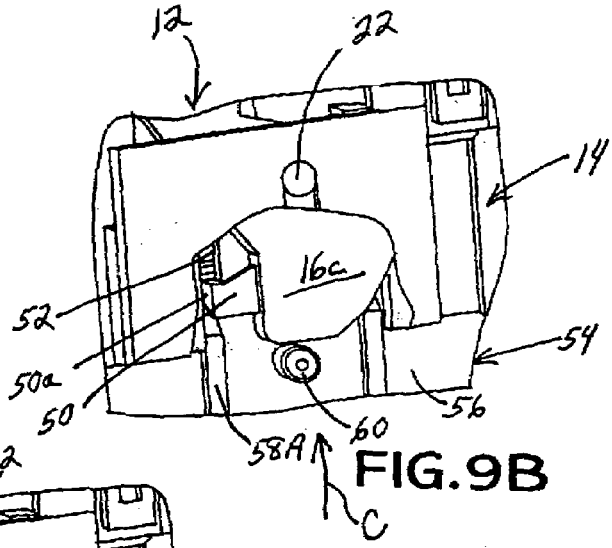
FIG. 9B is an enlarged, fragmented perspective view of the second latch means in the position shown in FIG. 9A.
Figure 9C:
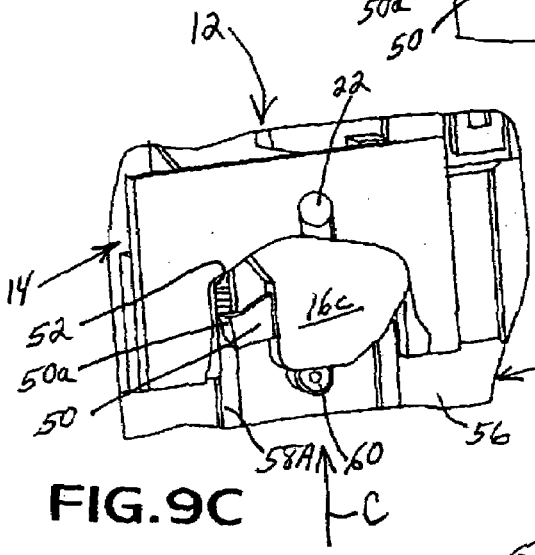
FIG. 9C is a view similar to that of FIG. 9B but with the second latch means in a released position to permit pivoting of the lever towards its fully locked position.
Figure 10:
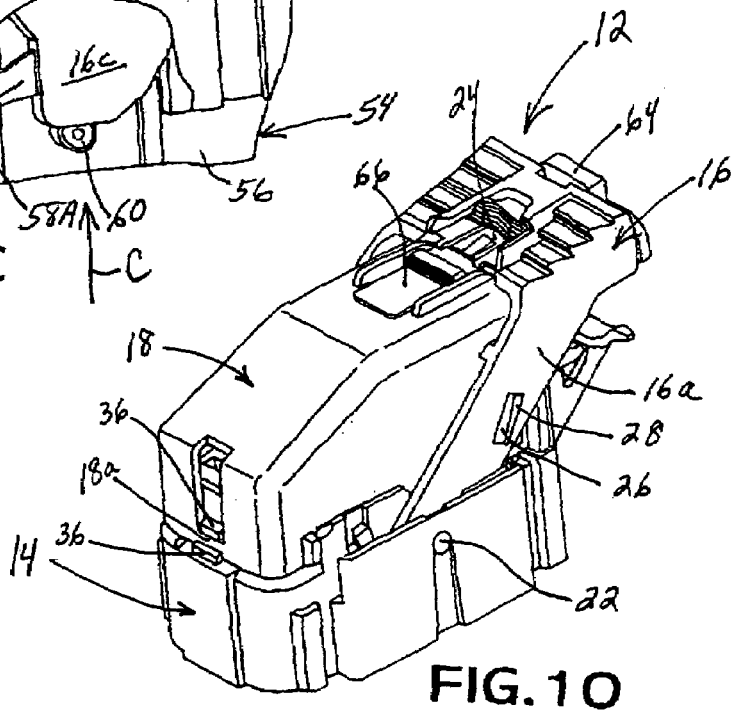
FIG. 10 is a perspective view of the lever type electrical connector assembly of the invention, fully assembled and with the lever structure in its mated position.

Referring to the drawings in greater detail, and first to FIG. 10, the invention is embodied in a lever type electrical connector assembly ("connector"), generally designated 12, which includes three major components, namely: a dielectric connector housing ("housing"), generally designated 14; a lever structure ("lever"), generally designated 16; and a wire dress cover ("cover"), generally designated 18. Lever 16 is pivotally movably mounted on the housing for movement in a pivotal operating stroke between a pre-load position at one end of the stroke as shown in FIGS. 1–4, and a mated position at an opposite end of the stroke as shown in FIG. 10. The lever moves through an intermediate or pre-mated position as shown in FIGS. 6–9. The invention contemplates that means be provided to hold the lever in any one of these three positions.

Referring specifically to FIGS. 1–4, housing 14 includes a plurality of terminal-receiving passages 20 within which are mounted a plurality of conductive terminals (not visible in the drawings). The housing has a forward end 14*a* for mating with a complementary mating connector (described hereinafter) and a rear end 14*b* for receiving a plurality of electrical wires (not shown) for termination to the terminals. In essence, the terminals have contact ends within passages 20 near forward end 14*a* of the housing for engaging appropriate terminals of the mating connector. The terminals have terminating ends near rear end 14*b* of the housing for termination to the electrical wires. The terminals may be pre-terminated to the wires before the terminals are inserted into passages 20. The wires may be organized and gathered onto a yoke portion 14*c* of the housing and clamped thereto by an appropriate clamping means (not shown).

Figure 1:
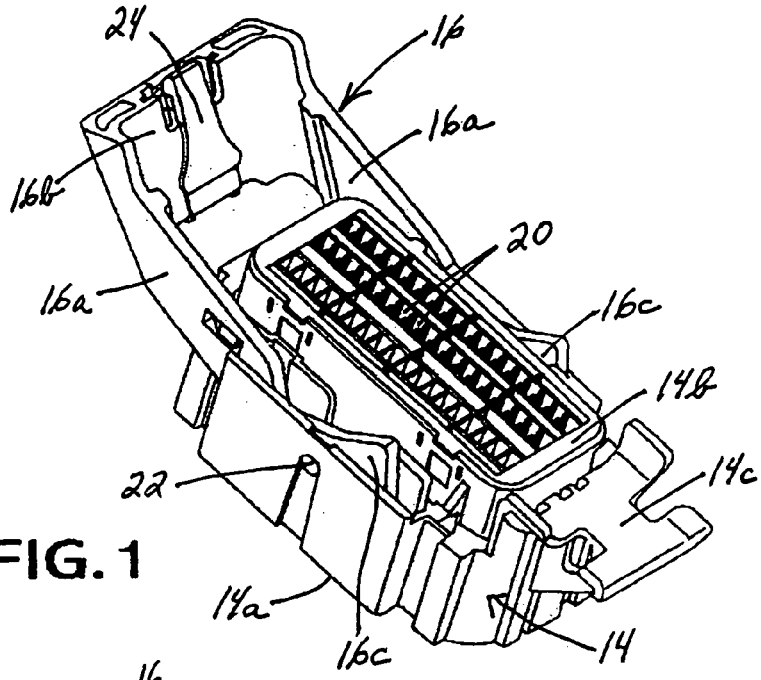
FIG. 1 is a top perspective view of the connector housing and mating assist lever of the connector according to the invention, with the lever in its pre-load position.

Still referring to FIGS. 1–4, mating assist lever 16 is a generally U-shaped structure and includes a pair of mating actuating arms 16*a* pivotally mounted on opposite sides of housing 14 by pivot posts 22 which project to opposite sides of each actuating arm. The actuating arms are joined at their free ends by a cross portion 16*b* of the U-shaped lever. As best seen in FIG. 1, the cross portion has a flexible locking arm 24 to lock the lever in its mated position as described hereinafter. Each actuating arm 16*a* has an actuating portion 16*c* which projects beyond pivot post 22 and which, as is known in the art, has a cam groove (not visible in the drawings) formed on the inside thereof for receiving a cam post of the mating connector to draw the mating connector toward mating end 14*a* of housing 14 when lever 16 is pivoted to its mated position (FIG. 10).

Figure 2:
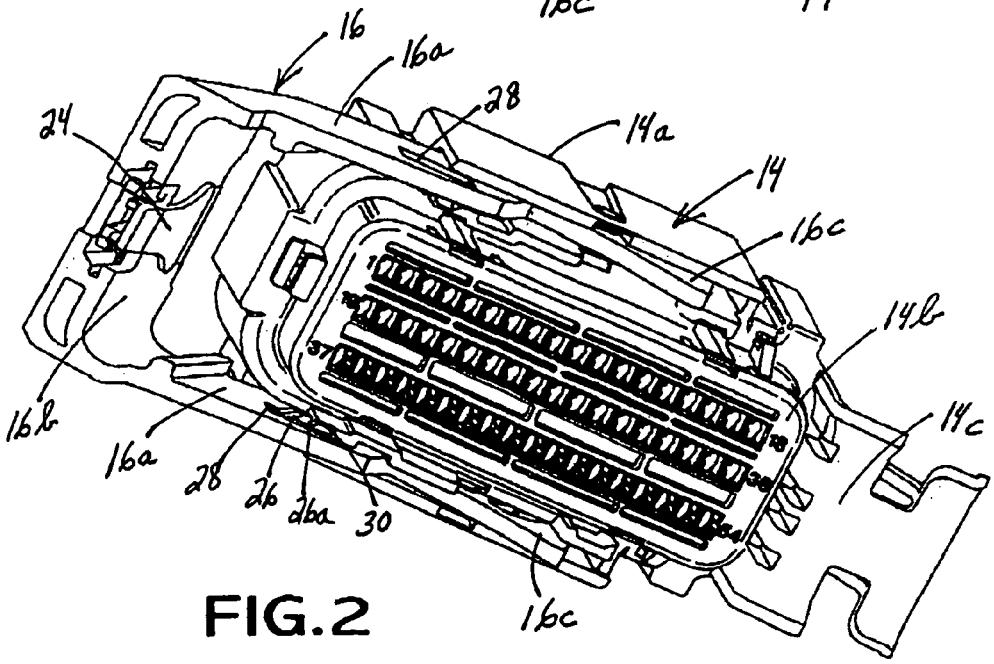
FIG. 2 is another perspective view similar to that of FIG. 1, but at a more vertical angle to show the latch means inside one of the lever arms of the lever structure.
Figure 3:
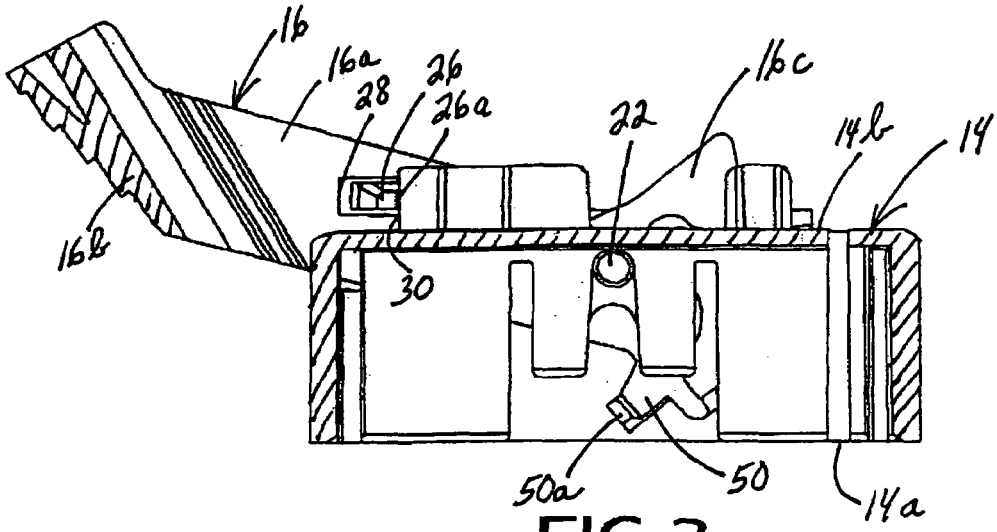
FIG. 3 is a side elevational view of the assembly of FIGS. 1 and 2.
Figure 4:
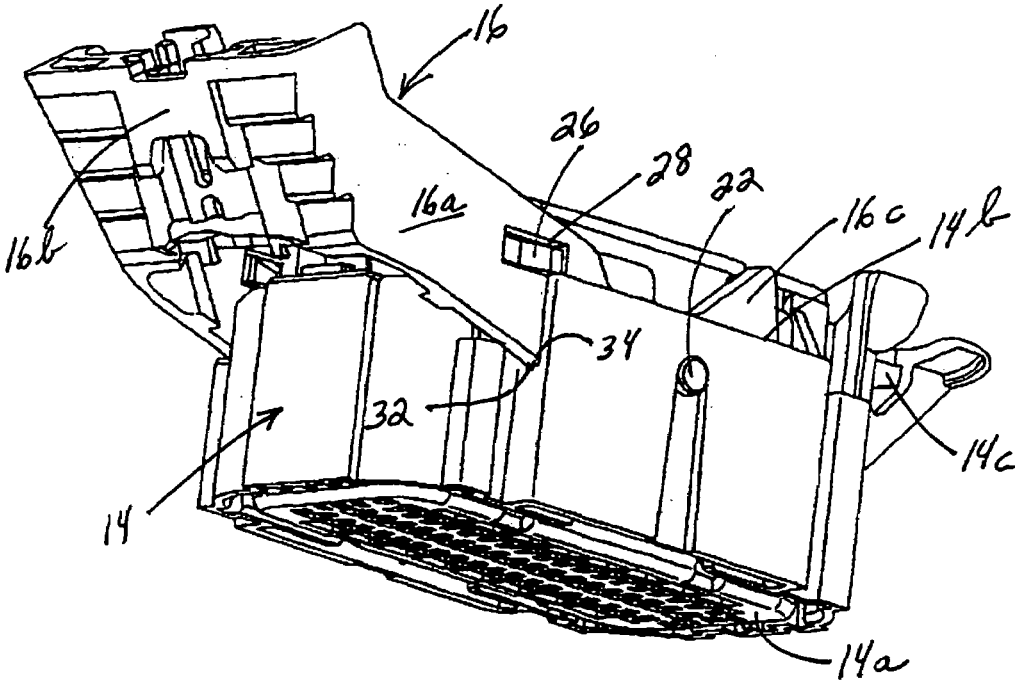
FIG. 4 is a bottom perspective view of the assembly of FIGS. 1–3.

Generally, first interengaging latch means are provided between housing 14 and lever 16 to hold the lever in its pre-load position shown in FIGS. 1–4. Specifically, as best seen in FIGS. 2 and 3, a flexible latch tab 26 is formed out of an opening 28 in each actuating arm 16*a* of lever 16. The latch tab is free to flex within opening 28. The latch tab has a latch surface 26*a* which engages a latch shoulder 30 on housing 14. The interengagement between latch surfaces 26*a* of latch tabs 26 with latch shoulders 30 of the housing prevent the lever from moving away from its pre-load position toward its mating position. Referring to FIG. 4, each actuating arm 16*a* of lever 16 includes an abutment surface 32 which engages an abutment surface 34 on housing 14 to define a stop means to prevent the lever from pivoting in the opposite direction.

Figure 5A:
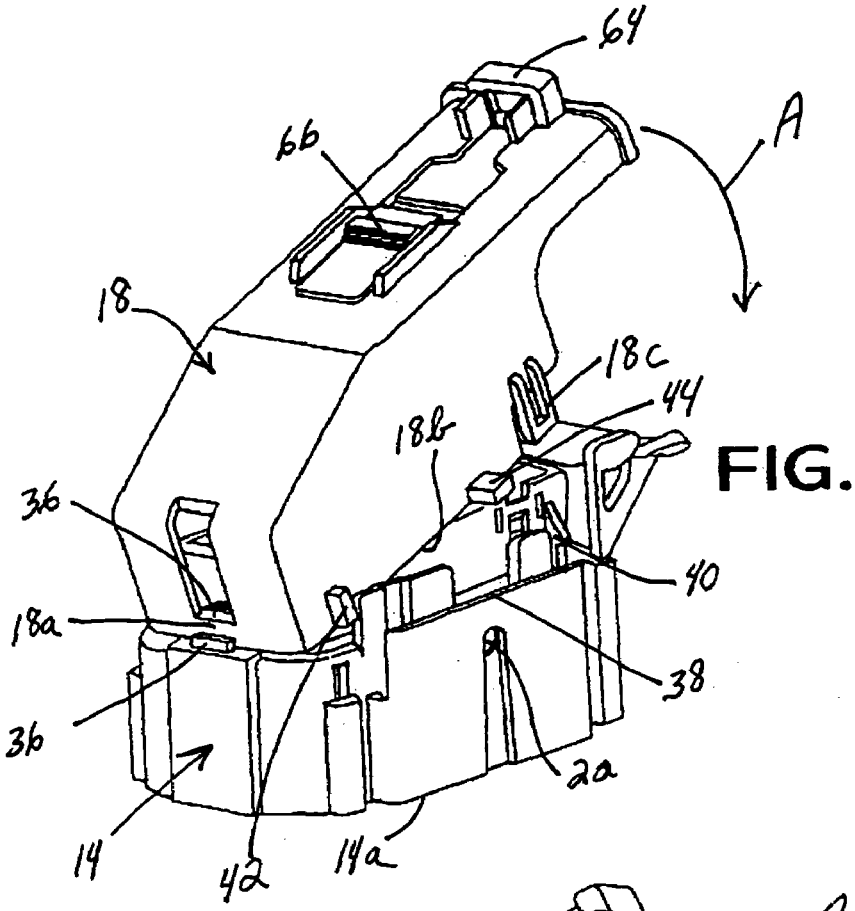
FIG. 5A is a perspective view showing the wire dress cover in the process of being mounted on the housing (the lever structure being removed to facilitate the illustration)
Figure 5B:
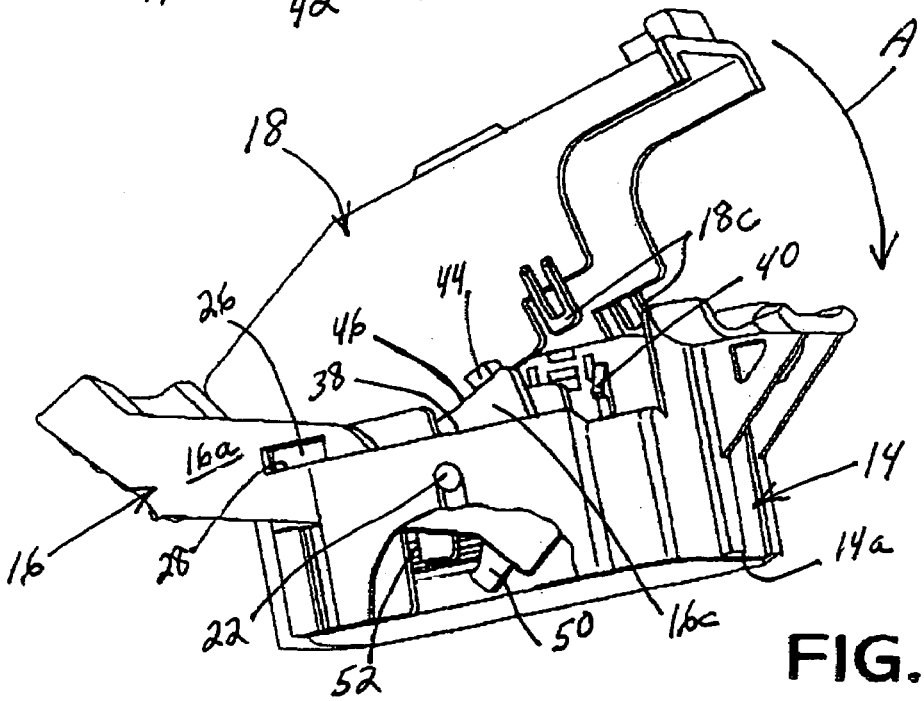
FIG. 5B is another perspective view similar to that of FIG. 5A, but with the lever structure included and the housing partially cut-away.
Figure 6:
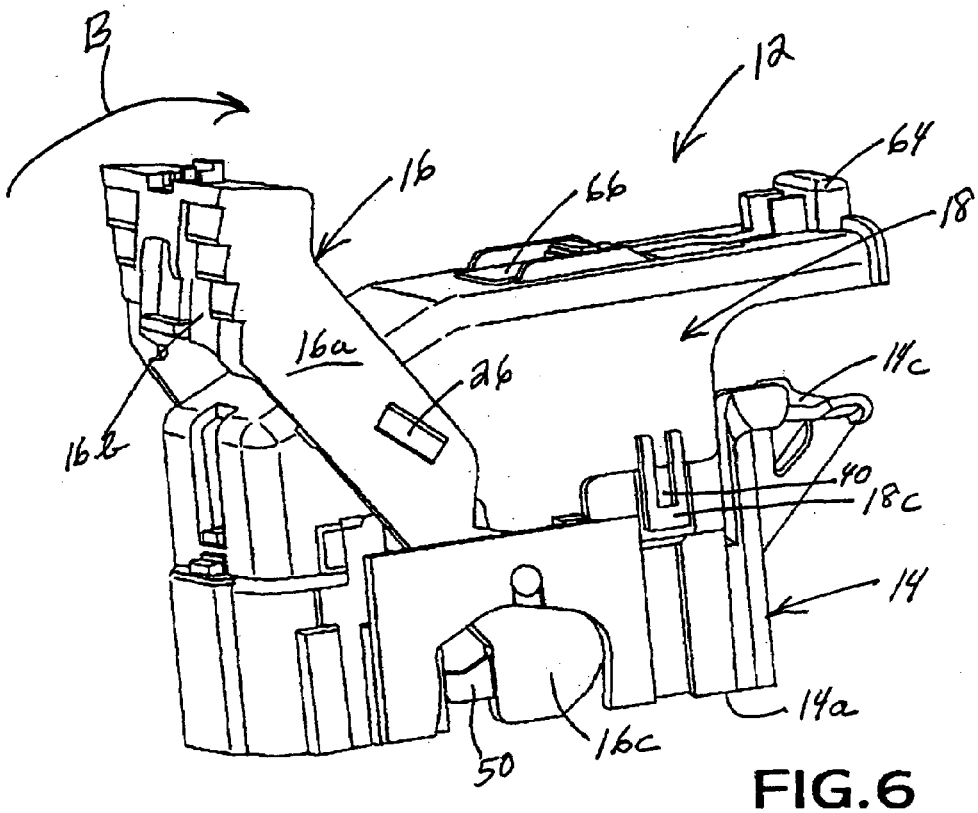
FIG. 6 is a perspective view of the wire dress cover fully mounted on the housing, and with the lever structure in its pre-mated position.

FIGS. 5A and 5B show wire dress cover 18 being mounted on top of housing 14. As seen in FIG. 5A, the wire dress cover has a strip-like portion 18*a* which is positionable between a pair of bosses 36 on housing 14 so that the cover can be properly positioned and pivoted downwardly in the direction of arrow "A" until a bottom peripheral edge 18*b* of the cover engages a peripheral ridge 38 on the housing. The cover is locked in its closed position (FIG. 6) by a locking yoke 18*c* on each opposite side of the cover snapping over a locking hook 40 on the housing.

Generally, release means are provided on cover 18 for disengaging latch tabs 26 on the lever from latch shoulders 30 on the housing to allow the lever to be pivoted after the cover is mounted on the housing. Specifically, FIG. 5A shows a release boss 42 projecting outwardly from one side of cover 18. A similar release boss also projects outwardly from the opposite side of the cover. When the cover is mounted to the top of housing 14 and is pivoted downwardly in the direction of arrow "A", release bosses 42 engage latch tabs 26 on actuating arms 16*a* of lever 16 and bias the flexible latch tabs away from latch shoulders 30 on the housing. This is accomplished automatically in response to mounting the cover onto the housing.

Figure 7:
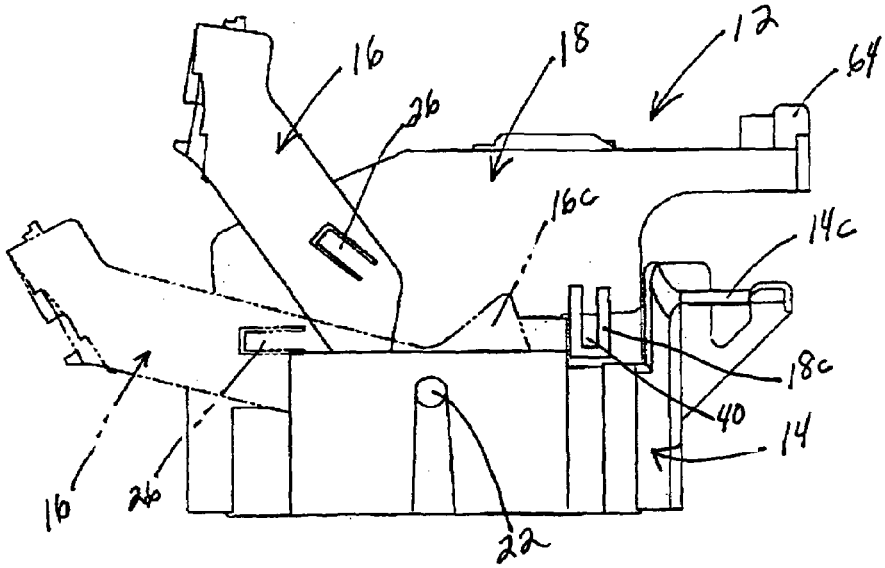
FIG. 7 is a side elevational view of the assembly of FIG. 6, and showing the lever structure in phantom in its pre-load position.

Generally, pusher means are provided on cover 18 to pivotally move lever 16 from its pre-load position of FIGS. 1–4 to a pre-mated position shown in FIGS. 6–9. Specifically, FIG. 5B shows a pusher boss 44 projecting outwardly from one side of cover 18. There is a second pusher boss similarly located and projecting outwardly from the opposite side of the cover. As the cover is pivotally mounted in the direction of arrow "A" while mounting the cover onto housing 14, pusher bosses 44 engage upper edges 46 of actuating portions 16*c* of actuating arms 16*a* of the lever. With latch tabs 26 now being released by release bosses 42, movement of the cover onto the top of the housing, as described above, is effective to pivot lever 16 in the direction of arrow "B" (FIG. 6) to its pre-mated position shown in FIG. 6. FIG. 7 shows lever 16 in phantom in its pre-load position and in full lines in its pre-mated position.

Figure 8:
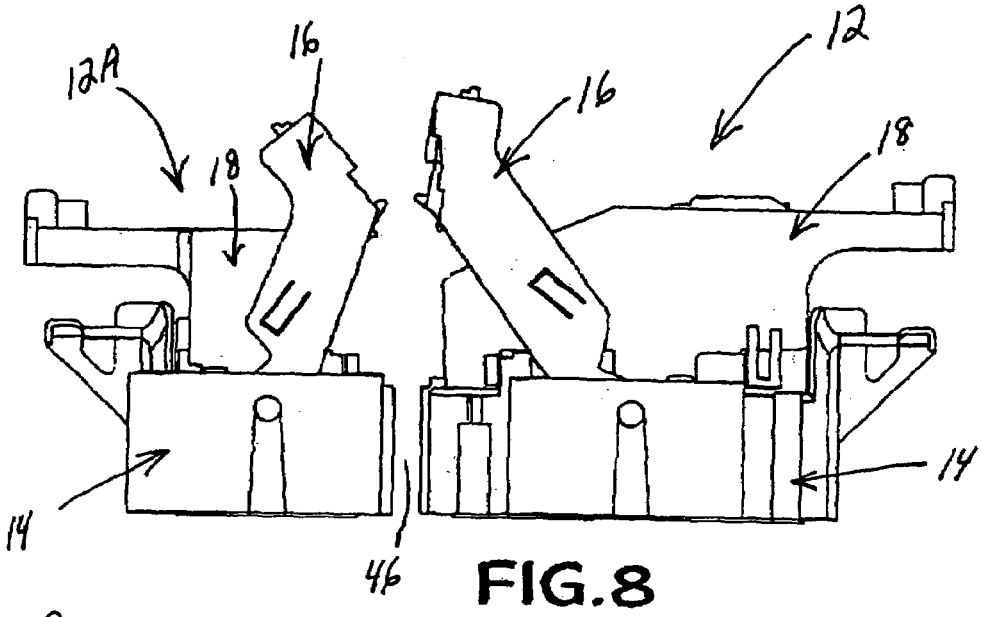
FIG. 8 is a side elevational view of a pair of lever type electrical connectors according to the invention, in a back-to-back juxtaposition and with the lever structures in their pre-mated positions.

The intermediate or pre-mated position of lever 16 affords a considerable advantage as is exemplified in FIGS. 7 and 8. In particular, there are instances wherein a pair of lever type electrical connectors must be mounted in close proximity in a back-to-back arrangement as shown in FIG. 8. Connector 12A in FIG. 8 simply is shorter than connector 12 in a horizontal direction. Regardless, both connectors show the levers in pre-mated positions which allow the connectors to be juxtaposed quite close to each other, as at 46. If the levers were not moved from their pre-load positions to the pre-mated positions, the connectors could not be mounted so close together, as can be understood by the phantom position of lever 16 shown in FIG. 7.

Generally, second interengaging latch means are provided between housing 14 and lever 16 to hold the lever in its pre-mated position described immediately above. Specifically, a flexible latch arm 50 is provided on each actuating arm 16*a* of the lever. The flexible latch arm has a latching tongue 50*a* which moves into a latching slot 52 in the housing as the lever moves to its pre-mated position. This holds the lever in the pre-mated position.

FIGS. 9A–9C show a complementary mating connector, generally designated 54, which is mateable with connector 12 in the direction of arrow "C". The mating connector includes a housing 56 which has a number of reinforcing ribs 58. One of the reinforcing ribs 58A is a release rib and is aligned with latching slot 52 in housing 14. Pushing connector 12 toward or onto connector 54 causes release rib 58A to bias flexible latch arm 50 outwardly as seen in FIG. 9C and moves latching tongue 50*a* out of latching slot 52. This happens while cam followers 60 on the mating connector enter the cam grooves at the insides of actuating portions 16*c* of actuating arms 16*a* of the lever. With latching tongues 50*a* moved out of latching slots 52, the lever can be pivoted in the direction of arrow "D" (FIG. 9A) to draw connectors 12 and 54 together into their fully mated condition as the lever moves to its fully mated position shown in FIG. 10.

Finally, lever 16 is releasably locked in its fully mated position of FIG. 10. Specifically, locking arm 24 (FIG. 1) on cross portion 16*b* of lever 16 locks beneath a locking bridge 64 on the top of cover 18 which, in turn, is locked to housing 14 as described above. If it is desired to pivot lever 16 back away from its fully mated position to unmate the connectors, a release lever 66 (FIGS. 5A and 10) is depressed to engage and move locking arm 24 out of engagement with locking bridge 64.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A lever type electrical connector assembly, comprising:

a connector housing for mounting a plurality of terminals and including a forward end for mating with a complementary mating connector and a rear end for receiving a plurality of pre-terminated wires;

a mating assist lever pivotally movably mounted on the housing for movement in a pivotal operating stroke between a pre-load position at one end of the stroke to allow the pre-terminated wires to be inserted into the connector housing and a mated position at an opposite end of the stroke;

interengaging latch means between the connector housing and the mating assist lever to hold the lever in its pre-load position; and a wire dress cover mountable over the rear end of the connector housing to protect said pre-terminated wires, the wire dress cover having release means for disengaging said latch means to allow the mating assist lever to be pivoted after the cover is mounted on the housing.

2. The lever type electrical connector assembly of claim 1 wherein said interengaging latch means are located for disengagement by said release means on the wire dress cover automatically in response to mounting the cover onto the connector housing.

3. The lever type electrical connector assembly of claim 1 wherein said interengaging latch means comprise at least one flexible latch member, and the release means engages and flexibly disengages the latch member.

4. The lever type electrical connector assembly of claim 3, including a pair of the latch members at opposite sides of the lever.

5. The lever type electrical connector assembly of claim 1 wherein said mating assist lever includes a pair of mating actuating arms pivotally mounted on opposite sides of the connector housing, said interengaging latch means being disposed between both actuating arms and the opposite sides of the housing.

6. The lever type electrical connector assembly of claim 5 wherein said release means are disposed on opposite side walls of the wire dress cover.

7. The lever type electrical connector assembly of claim 6 wherein said release means comprise a release boss projecting outwardly from each side wall of the wire dress cover.

8. The lever type electrical connector assembly of claim 1 wherein said interengaging latch means include means to prevent the mating assist lever from pivoting in opposite directions.

9. The lever type electrical connector assembly of claim 1, including second interengaging latch means between the connector housing and the mating assist lever to hold the lever in a pre-mated position between said pre-load and mated positions.

10. The lever type electrical connector assembly of claim 9 wherein said second interengaging latch means are located for release by the complementary mating connector.

11. The lever type electrical connector assembly of claim 10 wherein said second interengaging latch means comprise a flexible latch arm engageable with a latch release shoulder on the mating connector.

12. The lever type electrical connector assembly of claim 11 wherein said mating assist lever includes a pair of actuating arms pivotally mounted on opposite sides of the connector housing, one of said flexible latch arms being disposed on each actuating arm.

13. The lever type electrical connector assembly of claim 1, including pusher means on the wire dress cover to move the mating assist lever to a pre-mated position once said latch means are released.

14. The lever type electrical connector assembly of claim 13, including second interengaging latch means between the connector housing and the mating assist lever to hold the lever in said pre-mated position.

15. A lever type electrical connector assembly, comprising:

a connector housing for mounting a plurality of terminals and including a forward end for mating with a complementary mating connector and a rear end for receiving a plurality of pre-terminated wires;

a generally U-shaped mating assist lever having a pair of actuating arms pivotally movably mounted on opposite sides of the housing for movement in a pivotal operating stroke between a pre-load position at one end of the stroke to allow the pre-terminated wires to be inserted into the connector housing and a mated position at an opposite end of the stroke;

interengaging latch means between both actuating arms of the mating assist lever and opposite sides of the housing to hold the lever in its pre-load position;

a wire dress cover mountable over the rear end of the connector housing to protect the pre-terminated wires, the wire dress cover having release means for disengaging said latch means to allow the mating assist lever to be pivoted after the cover is mounted on the housing; and said interengaging latch means and said release means being located for disengagement by said release means on the wire dress cover automatically in response to mounting the cover onto the connector housing.

16. The lever type electrical connector assembly of claim 15 wherein said interengaging latch means comprise a flexible latch member on each actuating arm of the lever, and the release means engages and flexibly disengages the latch member.

17. The lever type electrical connector assembly of claim 16 wherein said release means comprise a release boss projecting outwardly from each side wall of the wire dress cover.

18. The lever type electrical connector assembly of claim 15, including second interengaging latch means between the connector housing and the mating assist lever to hold the lever in a pre-mated position between said pre-load and mated positions.

19. The lever type electrical connector assembly of claim 18 wherein said second interengaging latch means are located for release by the complementary mating connector.

20. The lever type electrical connector assembly of claim 19 wherein said second interengaging latch means comprise a flexible latch arm engageable with a latch release shoulder on the mating connector.

21. The lever type electrical connector assembly of claim 20 wherein said mating assist lever includes a pair of actuating arms pivotally mounted on opposite sides of the connector housing, one of said flexible latch arms being disposed on each actuating arm.

22. The lever type electrical connector assembly of claim 15, including pusher means on the wire dress cover to move the mating assist lever to a pre-mated position once said latch means are released.

23. The lever type electrical connector assembly of claim 22, including second interengaging latch means between the connector housing and the mating assist lever to hold the lever in said pre-mated position.

24. A lever type electrical connector assembly, comprising:

a connector housing for mounting a plurality of terminals and including a forward end for mating with a complementary mating connector and a rear end for receiving a plurality of pre-terminated wires;

a mating assist lever pivotally movably mounted on the housing for movement in a pivotal operating stroke between a pre-load position at one end of the stroke to allow the pre-terminated wires to be inserted into the connector housing and a mated position at an opposite end of the stroke;

a wire dress cover mountable over the rear end of the connector housing to protect the pre-terminated wires, and interengaging latch means between the connector housing and the mating assist lever to hold the lever in a pre-mated position between said pre-load position and said mated position after the wire dress cover is mounted on the housing.

25. The lever type electrical connector assembly of claim 24 wherein said interengaging latch means are located for release by the complementary mating connector.

26. The lever type electrical connector assembly of claim 25 wherein said interengaging latch means comprise a flexible latch arm engageable with a latch release shoulder on the mating connector.

* * * * *